US010317069B2

(12) United States Patent
Johnson

(10) Patent No.: US 10,317,069 B2
(45) Date of Patent: Jun. 11, 2019

(54) BOW CANDLE SYSTEM

(71) Applicant: The I See You Company, LLC, Nashville, TN (US)

(72) Inventor: James D. Johnson, Nashville, TN (US)

(73) Assignee: THE I SEE YOU COMPANY, LLC, Nashville, TN (US)

( * ) Notice: Subject to any disclaimer, the term of this patent is extended or adjusted under 35 U.S.C. 154(b) by 233 days.

(21) Appl. No.: 15/484,944

(22) Filed: Apr. 11, 2017

(65) Prior Publication Data

US 2018/0292083 A1 Oct. 11, 2018

(51) Int. Cl.
*D04D 7/10* (2006.01)
*F21V 35/00* (2006.01)

(52) U.S. Cl.
CPC ..... *F21V 35/00* (2013.01); *D04D 7/10* (2013.01)

(58) Field of Classification Search
CPC ..... F21V 35/00; D04D 7/10
USPC ..... 431/297, 2, 289
See application file for complete search history.

(56) References Cited

U.S. PATENT DOCUMENTS

| | | | | |
|---|---|---|---|---|
| 3,229,870 | A * | 1/1966 | Capstick | D04D 7/10 223/46 |
| 5,509,586 | A * | 4/1996 | Leiser | D04D 7/10 223/46 |
| 7,168,948 | B2 * | 1/2007 | Swearingen | A47G 33/06 362/161 |
| 2011/0280008 | A1 * | 11/2011 | Bakian | F21S 6/001 362/161 |
| 2014/0083444 | A1 * | 3/2014 | Grimm | A45D 8/00 132/148 |
| 2018/0259145 | A1 * | 9/2018 | Crawford | F21V 35/00 |

* cited by examiner

*Primary Examiner* — Gregory L Huson
*Assistant Examiner* — Nikhil P Mashruwala
(74) *Attorney, Agent, or Firm* — Shane Cortesi

(57) ABSTRACT

The present disclosure relates to, novelty items, more particularly candles that are placed in a candle holder that is attached to a bow. The base of the bow may include a fastener such as a sticker for attaching the bow to a lid of a coffee cup. The candle holder may be secured to the bow base using a fastener such as double-side adhesive, or a pin that protrudes through the base of the bow and the candle holder. Alternatively, the candle holder may be molded to the bow base.

18 Claims, 8 Drawing Sheets

BOW CANDLE SYSTEM

BACKGROUND

Technical Field

The present invention relates to novelty items and gifts, more particularly, to a candle that is designed to be placed in a bow.

Background of the Invention

Bows have been used for generations to put on birthday presents and Christmas presents.

U.S. Pat. No. 7,416,467 describes a bow with a concealed sound generator module having a battery, a tilt sensor, a data storage means, and a playback means which drives a speaker to emit prerecorded life-like sounds whenever the device is tilted more than 30 degrees from its normally level position Unique and personalized gifts are important, as small gestures can go a long way. Thus, there is a continuing need for new novelty items for gifts.

BRIEF SUMMARY

The present disclosure provides a bow candle system as described herein.

In some embodiments, the bow candle system includes a bow comprising a bow base, optionally an open top and optionally a bow interior located above the bow base. The bow candle system may also include a candle holder comprising a candle holder base attached to the bow and a candle holder recess. The bow candle system may further include a candle comprising a candle stem inserted (e.g., removably inserted) in the candle holder recess and a wick located above the candle stem.

Optionally, the candle holder further comprises a candle holder stem extending upwardly from the candle holder base and the recess is located in the candle holder stem. Optionally, the candle holder base further comprises a candle holder base fastener configured to attach the candle holder base to the bow. Optionally, the candle holder base fastener is an adhesive. Optionally, the candle holder base further comprises an aperture, and the candle holder base fastener is in the form of a pin extending through the bow base through the aperture and into the candle holder recess. Optionally, the aperture comprises a plurality of aperture grooves configured to allow expansion of the aperture. Optionally, the pin is located below the candle. Optionally, the pin is generally arrow-shaped with a pointed apex. Optionally, in lieu of a fastener, the candle holder base is integral to with the bow base (e.g., ultrasonically welded to the bow base). Optionally, the system further comprises a generally flat base located below and attached to the pin and the generally flat base is flush with the bow base. Optionally, the bow base further comprises a bow base fastener configured to attach the bow base to a lid of a cup or other substrate. Optionally, the system further comprises a cup having a lid and further wherein the bow base fastener attaches the bow base to the lid. Optionally, the lid is plastic. Alternatively, the lid and the bow base may be an integrally molded part. Optionally, the bow base fastener is an adhesive. Optionally, the bow base further comprises a cover removably covering the bow base fastener. Optionally, the candle holder is located approximately in a center of the bow. Optionally, the bow comprises ribbon forming a plurality of triangular projections spaced about the bow center and radiating laterally from the bow center. Optionally, the bow base is generally rectangular in shape.

BRIEF DESCRIPTION OF THE DRAWINGS

FIG. 1 also illustrates top perspective views of a candle holder of one embodiment of the present invention without a pin (left drawing) and with a pin (right drawing).

in FIG. 10, adhesive is being used to attach the candle holder to the bow; in FIG. 10, two views of the candle holder are shown in order to show the top and underside of the candle holder.

in FIG. 11, a pin is being used to attach the candle holder to the bow; in FIG. 11, two views of the candle holder are shown in order to show the top and underside of the candle holder.

DETAILED DESCRIPTION

Figure 1:
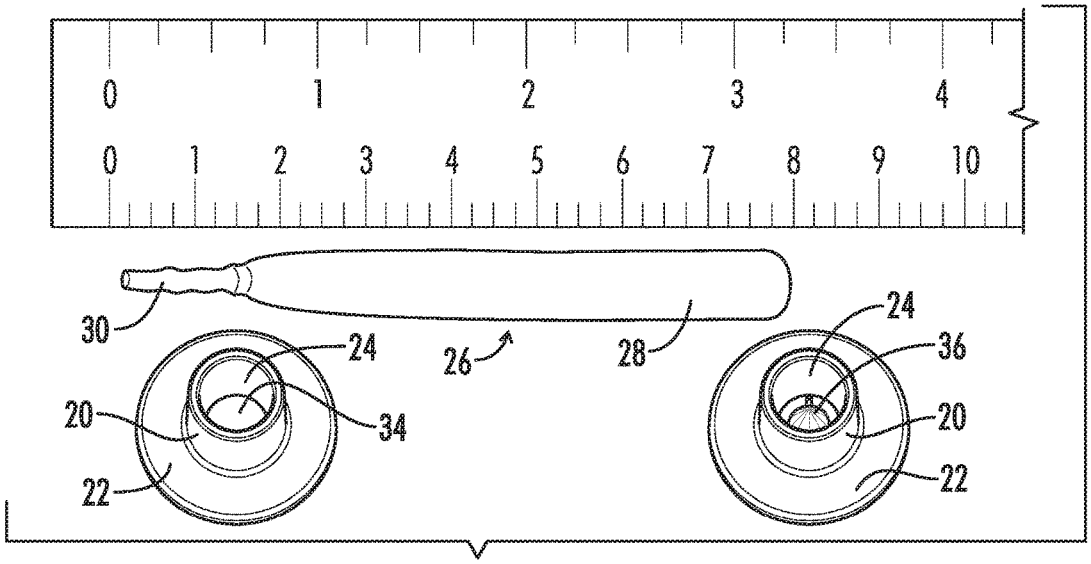
FIG. 1 is a side elevation view of one embodiment of a candle for use in the bow candle system of the present invention.
Figure 2:
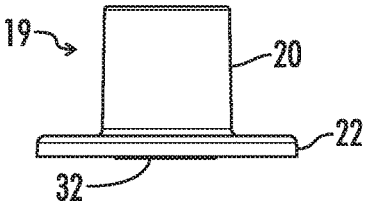
FIG. 2 is a side elevation of the candle holder of FIG. 1 without the pin.
Figure 4:
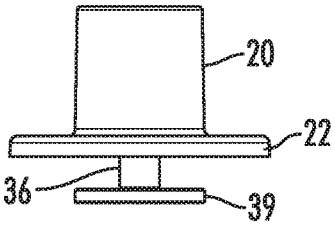
FIG. 4 is a side elevation view of the candle holder of FIG. 1 with the pin being inserted into the recess of the candle holder.
Figure 6:
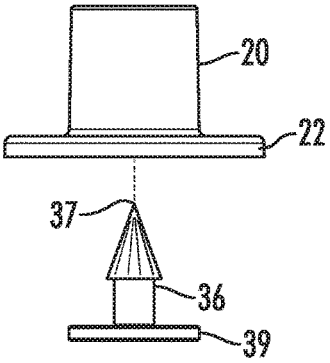
FIG. 6 is a side elevation view of the candle holder of FIG. 1 prior to the pin being inserted into the recess of the candle holder.
Figure 3:
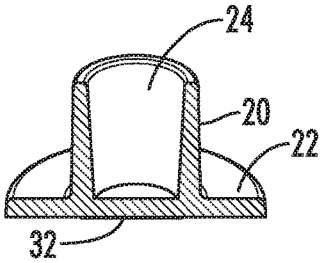
FIG. 3 is a side cross-sectional view of the candle holder of FIG. 2.
Figure 5:
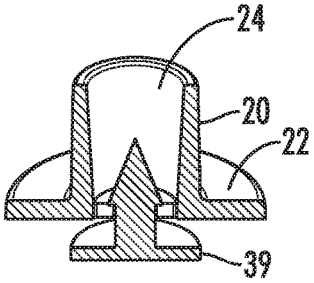
FIG. 5 is a side cross-sectional view of the pin and candle holder of FIG. 4.
Figure 7:
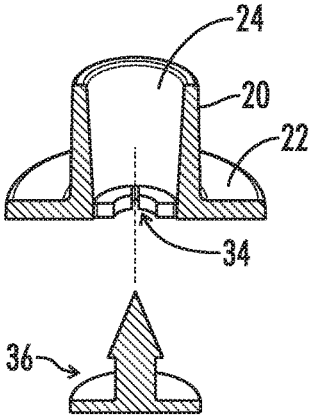
FIG. 7 is a side cross-sectional view of the pin and candle holder of FIG. 6.
Figure 8:
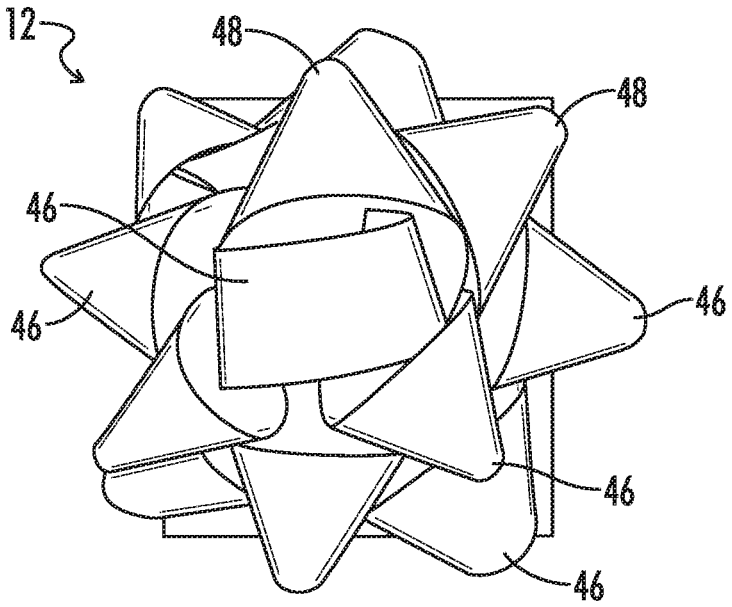
FIG. 8 is a top perspective view of a bow for use with the present invention.
Figure 9:
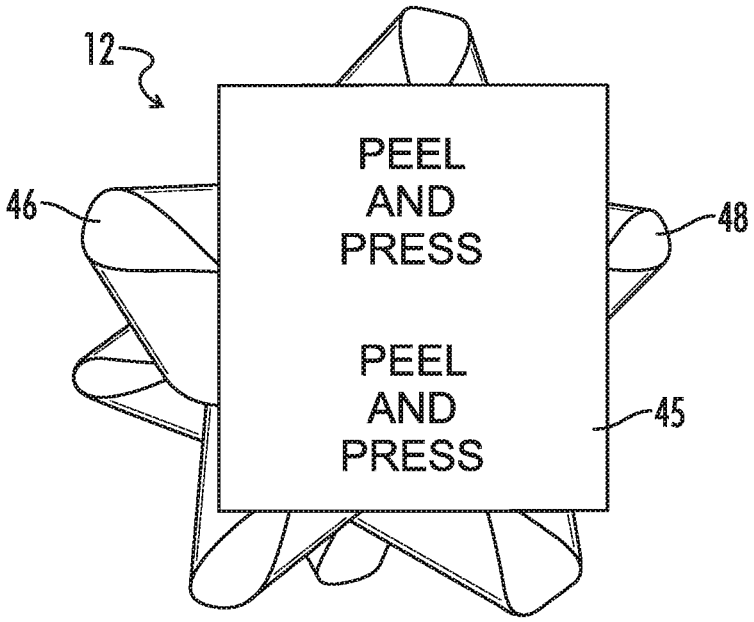
FIG. 9 is a bottom perspective view of the bow of FIG. 8.
Figure 10:
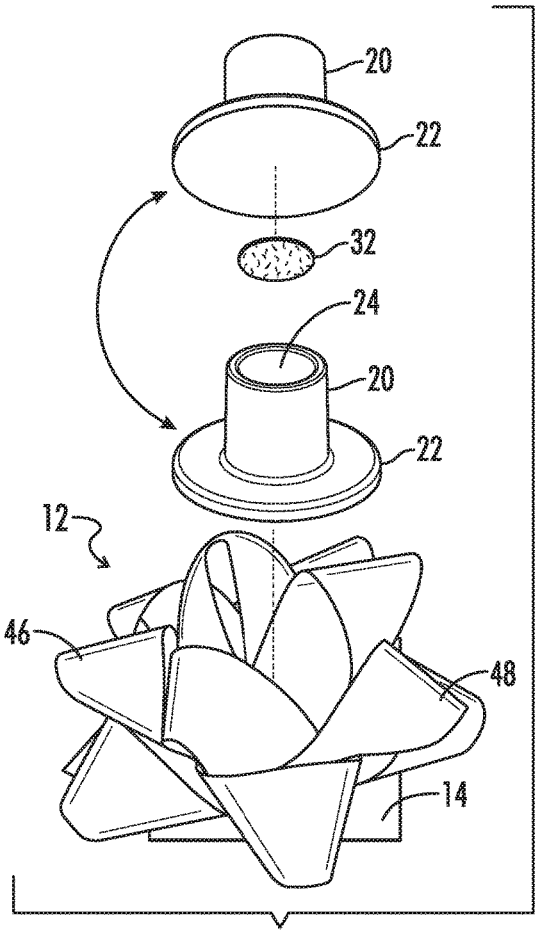
FIG. 10 is a side exploded perspective view of a bow candle system of one embodiment of the present invention.
Figure 11:
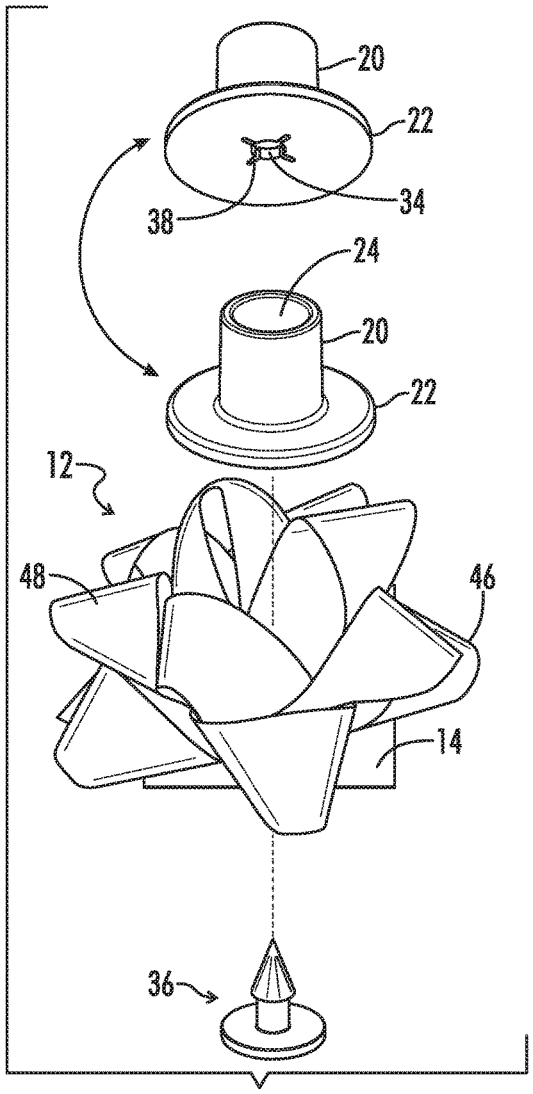
FIG. 11 is a side exploded perspective view of a bow candle system of another embodiment of the present invention.
Figure 12:
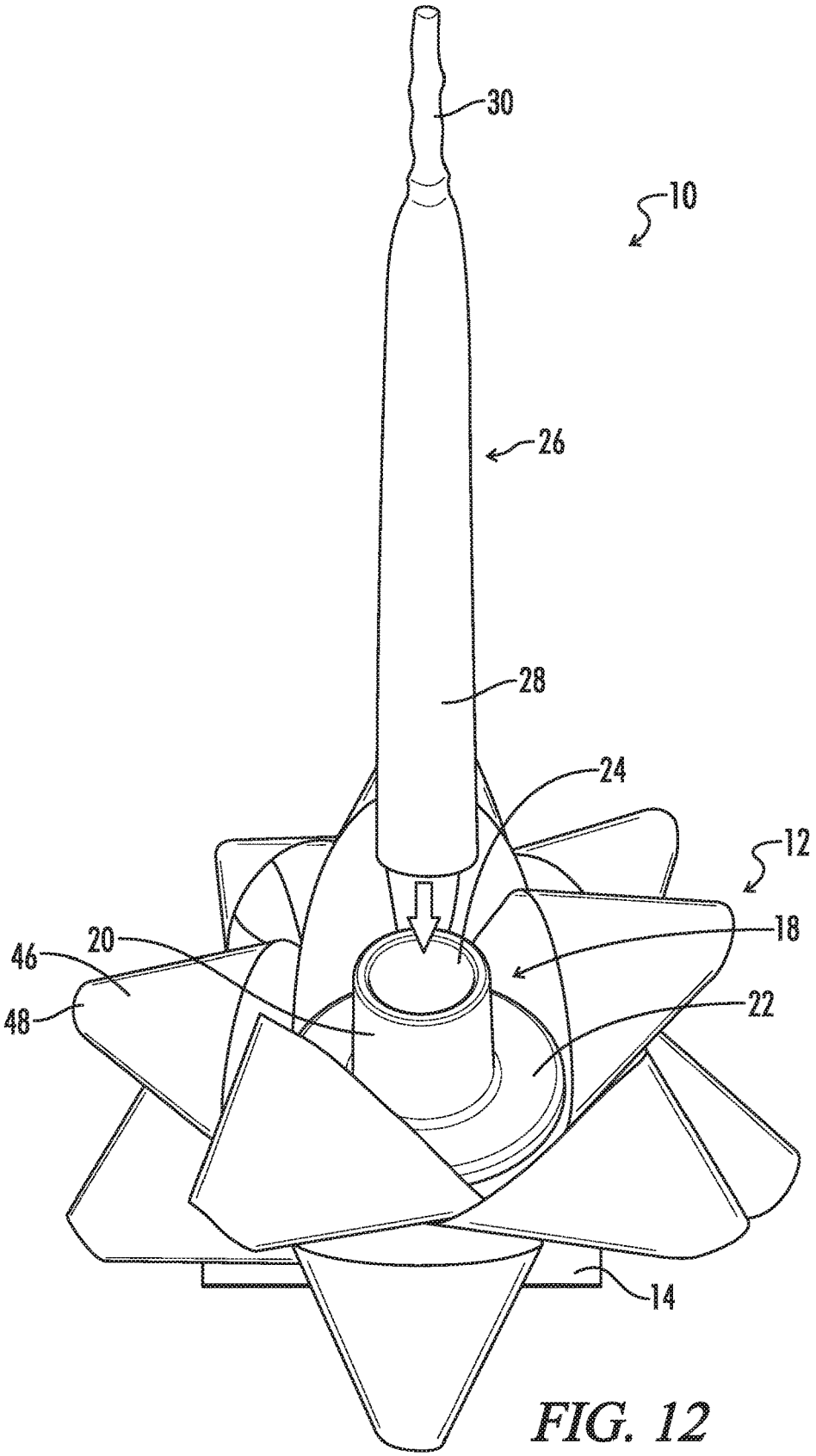
FIG. 12 is a top perspective partially exploded view of the bow candle system of FIG. 11.
Figure 13:
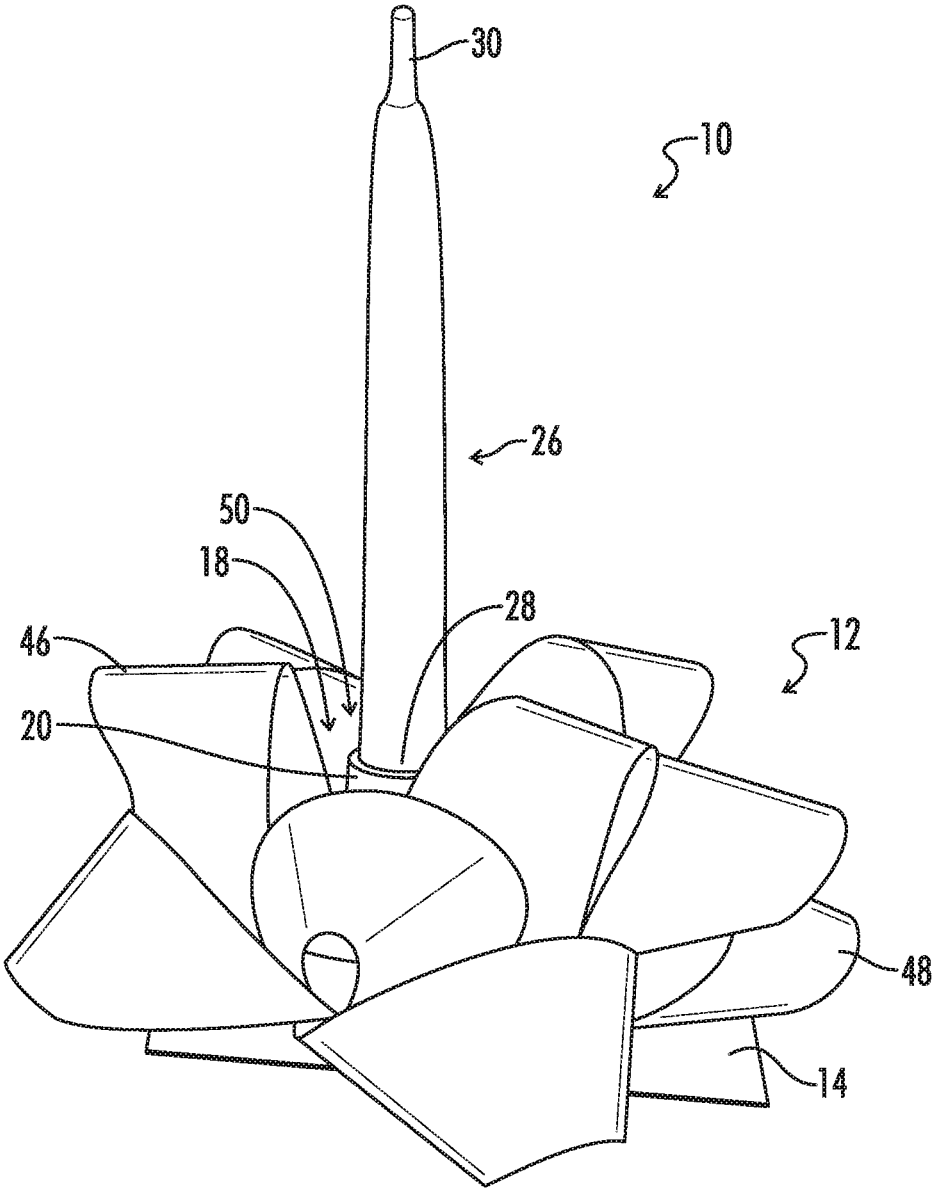
FIG. 13 is a top perspective assembled view of the bow candle system of FIG. 11.
Figure 14:
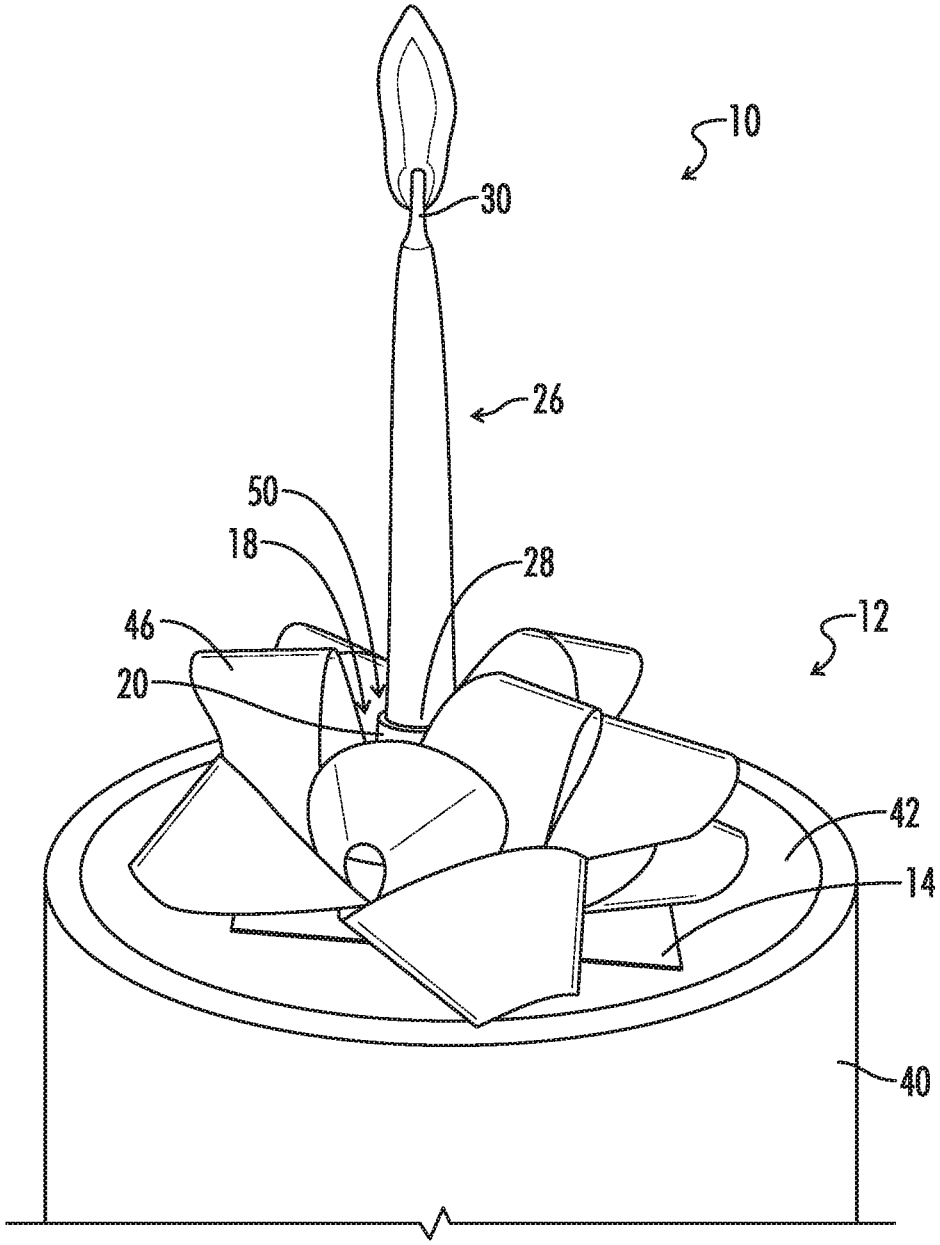
FIG. 14 is a top perspective assembled view of the bow candle system of FIG. 11 attached to the lid of a cup.
Figure 15:
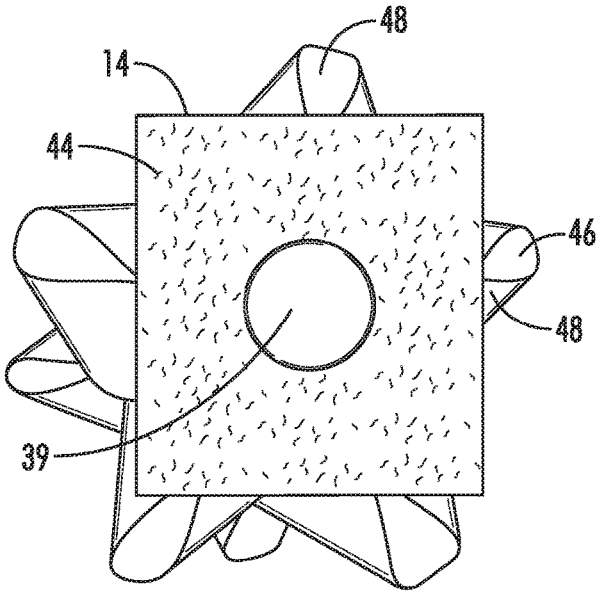
FIG. 15 is a bottom perspective assembled view of the bow candle system of FIG. 11.
Figure 16:
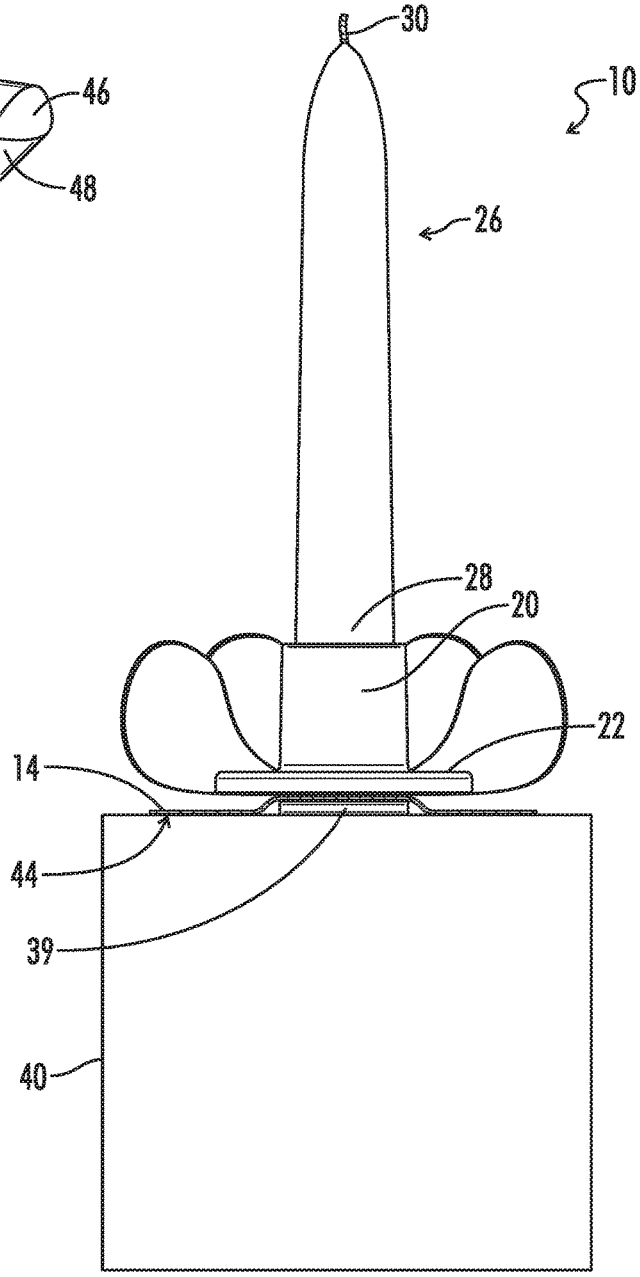
FIG. 16 is a side cross-sectional view of the bow candle system of FIG. 11 attached to the lid of a cup.

With reference to FIGS. 1-18, the present invention provides a bow candle system 10. In the drawings, not all reference numbers are included in each drawing for the sake of clarity.

Figure 17:
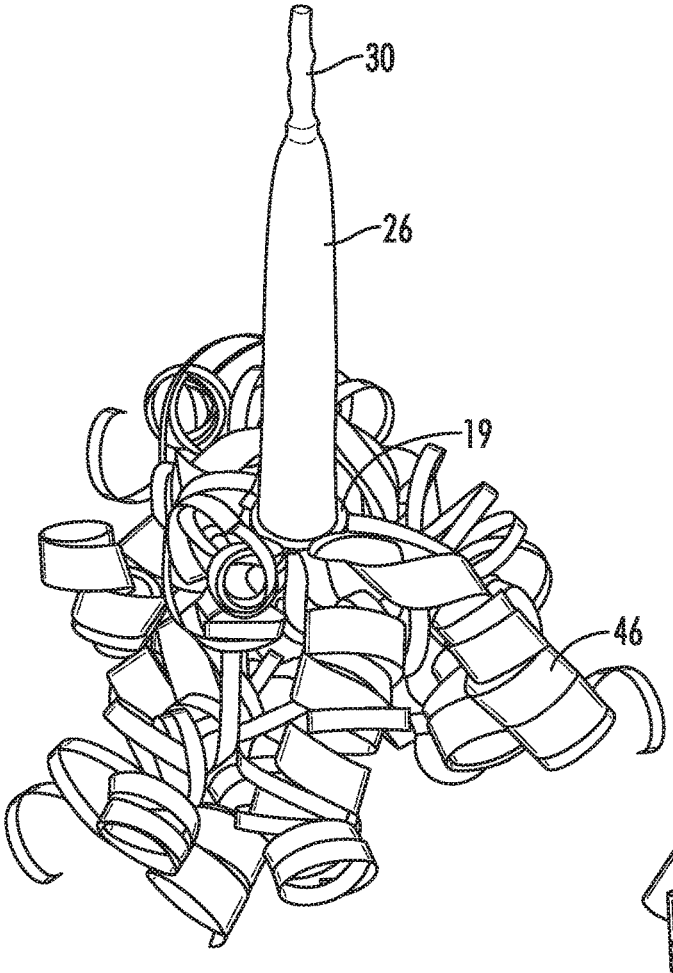
FIG. 17 is a side perspective view of a bow candle system of another embodiment of the present invention.
Figure 18:
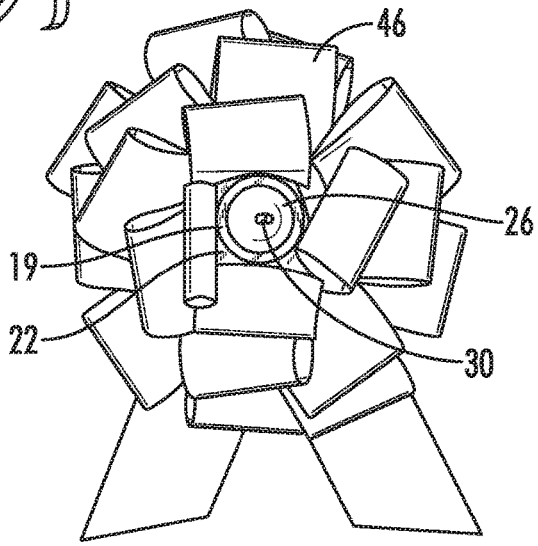
FIG. 18 is a top perspective view of a bow candle system of another embodiment of the present invention.

Referring further to FIGS. 1-18, the bow candle system 10 includes a bow 12 comprising a bow base 14, an open top 16 and a bow interior 18 located above the bow base 14. The bow 12 may be in the form of what is known in the art as a star bow and may comprise a bow center 50 and ribbon 46 forming a plurality of triangular projections 48 spaced about and radiating laterally from the bow center 50, as best seen in FIGS. 8, and 10-15. Such star bows are well-known in the art and often used with Christmas presents. Often such star bows include an adhesive 44, more particularly, a sticker and typically they have five to twelve points. However, the invention is not limited to star bows and the bow 12 may be bows of various styles and configurations, preferably with bases 14 that include an adhesive. For example, FIG. 17 shows a curly bow and FIG. 18 shows a slight variation of the star bow design.

It will understood that use of the singular herein, embraces use of the plural. Thus, the bow 12 may comprise multiple ribbons 46 for example.

Unlike traditional bows, the bow candle system 10 of the present invention further includes a candle holder 19 comprising a candle holder base 22 attached to the bow 12 (preferably attached to the bow base 14) and optionally a candle holder recess 24, and a candle 26. Optionally, the candle 26 comprises a candle stem 28 removably inserted in the candle holder recess 24 and a wick 30 located above the candle stem 28. As used herein, the term "attached" includes parts that are joined (e.g., using a fastener or ultrasonic welding for example) as well as integrally molded parts.

Optionally, the candle holder 19 further comprises a candle holder stem 20 extending upwardly from the candle holder base 22 and further wherein the recess 24 is located in the candle holder stem 20.

The bow candle system 10 may further include a candle holder base fastener configured to attach the candle holder base 22 to the bow 12. Two different fasteners, namely, an adhesive 32 and a pin 36, are show in the drawings. However, it will be understood that other fasteners may be used to attach the candle holder base 22 to the bow 12. More particularly, the candle holder base fastener may be an adhesive 32—e.g., double-sided tape that is generally circular in shape. In other embodiments, the candle holder base 22 further comprises an aperture 34, and the candle holder base fastener is in the form of a pin 36 extending through the bow base 14 through the aperture 34 and into the candle holder recess 24. Optionally, the aperture 34 comprises a plurality of linear aperture grooves 38 configured to allow expansion of the aperture 34. Optionally, the pin 36 is located below the candle 26. Optionally, the pin 36 is generally arrow-shaped with a pointed apex 37. Optionally, the bow candle system 10 further comprises a generally flat base 39 located below the pin 36 and further wherein the generally flat base 39 is flush with the bow base 14 when the pin is inserted through the bow base 14 through the aperture 34 and into the candle holder recess 24. The generally flat base 39 may be attached to the pin 36 (e.g., discrete parts that are joined or a single integral injected molded part). The candle holder base 22 may be any suitable size, e.g., 0.25 inches to about 3 inches in diameter.

Optionally, the bow base 14 further comprises a bow base fastener 44 configured to attach the bow base 14 to a lid 42 of a cup 40 (e.g., a disposable coffee cup having a plastic lid). For example, the bow base fastener 44 may be an adhesive and the bow base 14 may further include a cover 45 removably covering the bow base fastener 44. Alternatively, the bow base 14 may be attached to any other suitable substrate, including without limitation books, jewelry boxes, bottles of wine, jars and the like.

Optionally, the candle holder 19 is located approximately in the center 50 of the bow 12.

Optionally, the bow base 14 is generally rectangular in shape (e.g. a square).

In use, the candle wick 30 is located above (e.g., at least 1 inch above, more preferably at least 2 inches above) the ribbon 46 as shown in FIGS. 13-14 and 16-17 for example.

The bow candle system 10 may be assembled in any suitable order. For example, the candle holder base 22 may be attached to the bow 12, the candle 26 may be inserted in the candle holder recess 24, and then the bow base 14 may be attached to the lid 42. Alternatively, the candle 26 may be inserted in the candle holder recess 24 prior to attachment of the candle holder base 22 to the bow 12.

The candle holder 19 typically is located on the bow base 14, more particularly an upper and interior facing surface of the bow base 14 (e.g., integrally molded with the bow base 14, sonically welded to the bow base 14 or joined to the bow base 14 using a fastener, e.g., the adhesive 32 or pin 36 previously described). Preferably, the candle holder base 22 and bow base 14 are plastic. However, any suitable material may be used. Typically, an adhesive 44 is located on the lower surface of the bow base 14.

| PART LIST | |
|---|---|
| bow candle system | 10 |
| bow | 12 |
| bow base | 14 |
| bow base open top | 16 |
| bow interior | 18 |
| candle holder | 19 |
| candle holder stem | 20 |
| candle holder base | 22 |
| candle holder recess | 24 |
| candle | 26 |
| candle stem | 28 |
| wick | 30 |
| adhesive fastener #1 | 32 |
| aperture | 34 |
| pin | 36 |
| pin apex | 37 |
| aperture grooves | 38 |
| base | 39 |
| cup | 40 |
| lid | 42 |
| adhesive fastener #2 | 44 |
| sticker cover | 45 |
| ribbon | 46 |
| triangular projections | 48 |
| bow | |
| bow center | 50 |

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A bow candle system comprising:

a) a bow comprising a bow base;

b) a candle holder comprising a candle holder base extending upwardly from the bow base and a candle holder recess; and c) a candle comprising a candle stem removably inserted in the candle holder recess and a wick located above the candle stem, wherein the candle holder base is attached to the bow base, wherein the bow further comprises an open top and a bow interior located above the bow base, and further wherein the candle holder base is located in the bow interior.

2. The bow candle system of claim 1 wherein the candle holder further comprises a candle holder stem extending upwardly from the candle holder base and further wherein the recess is located in the candle holder stem.

3. The bow candle system of claim 1 wherein the candle holder base further comprises a candle holder base fastener attaching the candle holder base to the bow base.

4. The bow candle system of claim 3 wherein the candle holder base fastener is an adhesive.

5. The bow candle system of claim 3 wherein the candle holder base further comprises an aperture, and wherein the candle holder base fastener is in the form of a pin extending through the bow base through the aperture and into the candle holder recess.

6. The bow candle system of claim 5 wherein the aperture comprises a plurality of aperture grooves configured to allow expansion of the aperture.

7. The bow candle system of claim 5 wherein the pin is located below the candle.

8. The bow candle system of claim 5 wherein the pin is generally arrow-shaped with a pointed apex.

9. The bow candle system of claim 5 wherein the system further comprises a generally flat base located below and attached to the pin and further wherein the generally flat base is flush with the bow base.

10. The bow candle system of claim 1 wherein the bow base further comprises a bow base fastener configured to attach the bow base to a substrate.

11. The bow candle system of claim 10 wherein the system further comprises a cup having a lid and further wherein the bow base fastener attaches the bow base to the lid.

12. The bow candle system of claim 10 wherein the lid is plastic.

13. The bow candle system of claim 10 wherein the bow base fastener is an adhesive.

14. The bow candle system of claim 10 wherein the bow base further comprises a cover removably covering the bow base fastener.

15. The bow candle system of claim 1 wherein the candle holder is located approximately in a center of the bow.

16. The bow candle system of claim 15 wherein the bow comprises ribbon forming a plurality of triangular projections spaced about the bow center and radiating laterally from the bow center.

17. The bow candle system of claim 1 wherein the bow base is generally rectangular in shape.

18. The bow candle system of claim 1 wherein the bow comprises ribbon and the wick of the candle is located at least one inch above the ribbon.

* * * * *